US005436633A

United States Patent [19]

Liu

[11] Patent Number: 5,436,633

[45] Date of Patent: Jul. 25, 1995

[54] ADJUSTABLE ANTENNA ASSEMBLY FOR A PORTABLE TELEPHONE

[76] Inventor: An-Shuenn Liu, No. 74, Huai Teh St., Tien Chung Chen, Changhua Hsien, Taiwan

[21] Appl. No.: 142,615

[22] Filed: Oct. 25, 1993

[51] Int. Cl.[6] ..... H01Q 1/36

[52] U.S. Cl. ..... 343/723; 343/702; 343/895

[58] Field of Search ..... 343/702, 895, 900, 906, 343/745, 750, 752, 868, 723

[56] References Cited

U.S. PATENT DOCUMENTS

| | | | |
|---|---|---|---|
| 2,214,685 | 9/1940 | Stone | 343/894 |
| 5,214,434 | 5/1993 | Hsu | 343/749 X |
| 5,218,372 | 6/1993 | Cheng | 343/749 |
| 5,274,393 | 12/1993 | Scott | 343/702 X |

*Primary Examiner*—Donald Hajec
*Assistant Examiner*—Tho G. Phan
*Attorney, Agent, or Firm*—Peterson, Wicks, Nemer & Kamrath

[57] ABSTRACT

An adjustable antenna assembly for a portable telephone includes a tubular base removably attached to a portable telephone, a socket securely received in the tubular base and having an outer periphery which is threaded in an upper end thereof, a coil received in the socket with a lower end thereof electrically connected to the telephone for receiving and transmitting wireless signal waves to the telephone, a cap having a closed upper end and an open lower end, the cap further having a threaded inner periphery and being mounted around the threaded upper end of the socket and thus being movable relative to the socket along a longitudinal direction of the coil upon rotational movement thereof, and a compressing member mounted between an upper end of the coil and the upper end of the cap such that a pitch of the coil is adjustable upon adjustment of relative longitudinal position between the cap and the socket.

4 Claims, 4 Drawing Sheets

ADJUSTABLE ANTENNA ASSEMBLY FOR A PORTABLE TELEPHONE

BACKGROUND OF THE INVENTION

1. Field of the Invention

The present invention relates to an adjustable antenna assembly for a portable telephone.

2. Description of related art

A portable telephone is a convenient communication device. The antenna for a portable telephone generally includes a coil for receiving and transmitting wireless signal waves to the telephone for communication purpose. The pitch of the coil is appropriately dimensioned such that the frequency is in the range of 800–900 mega Hertz (MHz) and the standing-wave ratio is less than 2.33 to obtain an effective reception of signal waves. It is, however, found that the standing-wave ratio tends to be affected by terrains, especially when the user is near a highland, hill, or building. This causes defective communication and sometimes even causes disconnection as the pitch of the coil is not adjustable. Another drawback of conventional portable telephones is that the antenna is not removable and thus occupies a certain space.

The present invention provides an improved adjustable antenna assembly which is removably attached to a portable telephone.

SUMMARY OF THE INVENTION

The present invention provides an adjustable antenna assembly for a portable telephone which includes a tubular base removably attached to a portable telephone, a socket securely received in the tubular base and having an outer periphery which is threaded in an upper end thereof, a coil received in the socket with a lower end thereof electrically connected to the telephone for receiving and transmitting wireless signal waves to the telephone, a cap having a closed upper end and an open lower end, the cap further having a threaded inner periphery and being mounted around the threaded upper end of the socket and thus being movable relative to the socket along a longitudinal direction of the coil upon-rotational movement thereof, and a compressing member mounted between an upper end of the coil and the upper end of the cap such that a pitch of the coil is adjustable upon adjustment of relative longitudinal position between the cap and the socket.

Other objects, advantages, and novel features of the invention will become more apparent from the following detailed description when taken in conjunction with the accompanying drawings.

DESCRIPTION OF THE PREFERRED EMBODIMENT

Figure 1:
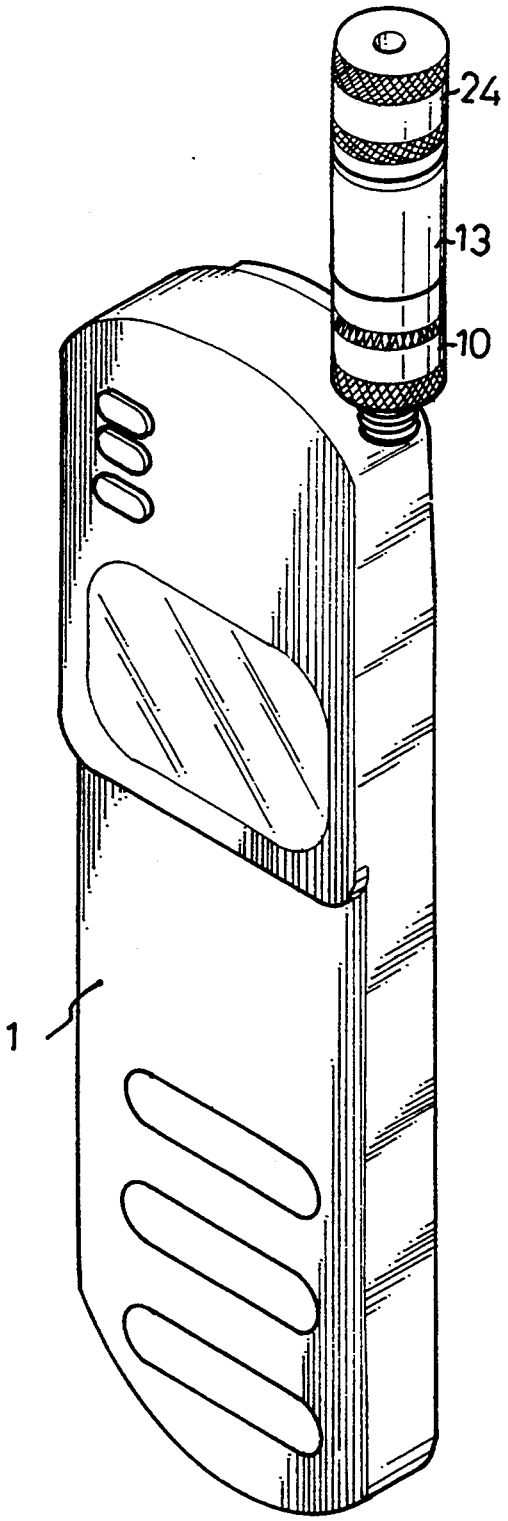
FIG. 1 is a perspective view of a portable telephone with an adjustable antenna assembly in accordance with the present invention.
Figure 2:
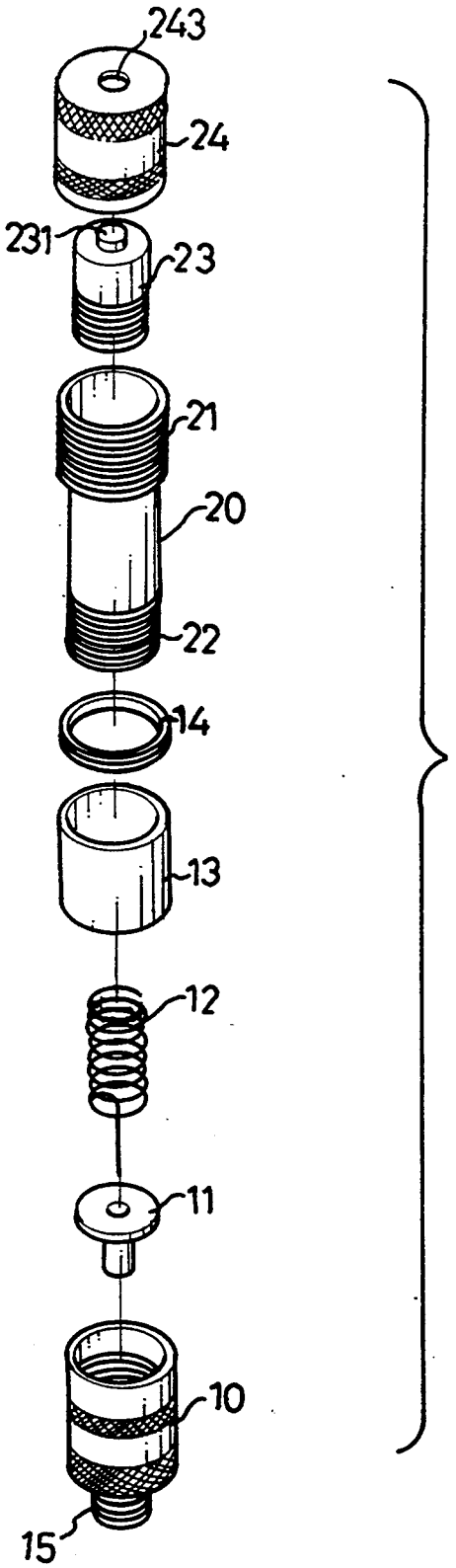
FIG. 2 is an exploded view of the adjustable antenna assembly in accordance with the present invention.
Figure 3:
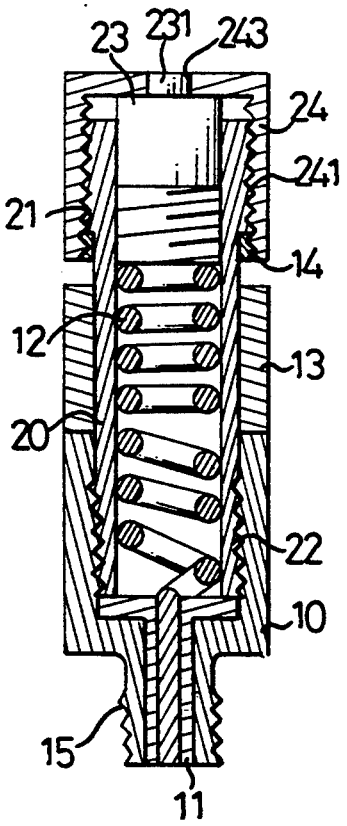
FIG. 3 is a cross-sectional view of the adjustable antenna assembly.

Referring to the drawings and initially to FIGS. 1 through 3, in accordance with the present invention, an adjustable antenna assembly for a portable telephone includes a tubular base 10 with a nipple 15 projecting from a bottom thereof for removable threading connection with a portable telephone 1, a guiding member 11 which is substantially T-shaped in section and is located in an inner side of the tubular base 10 with its hollow vertical section passing through the nipple 15, a socket 20 having an upper end 21 which has outer threadings and a lower end 22 which also has outer threadings so as to be received in the base 10 by threading engagement, a coil 12 received in the socket 20 with a lower end thereof passing through the vertical section of the T-shaped guiding member 11 to connect with the telephone 1 for receiving and transmitting wireless signal waves to the telephone 1, a second tubular member 13 is mounted around the socket 20, a ring 14 with outer threadings disposed below the threaded upper end 21 of the socket 20, a cap 24 having a closed upper end and an open lower end, the cap 24 being mounted around the threaded upper end 21 of the socket 20 and the ring 14 by a threaded inner periphery 241 thereof and thus being vertically movable upon rotation thereof, the cap 24 further having a hole 243 in the upper end thereof, and a compressing member 23 with a knob 231 projecting from a top thereof for engaging with the hole 243 in the cap 24 and with a lower end thereof resting on the upper end of the coil 12. It is appreciated that the outer threadings of the ring 14 align with and have a lead the same as that of the threadings of the inner periphery 241 to allow smooth rotational and vertical movement of the cap 24 relative to the upper end 21 of the socket 20 and the ring 14.

Figure 4:
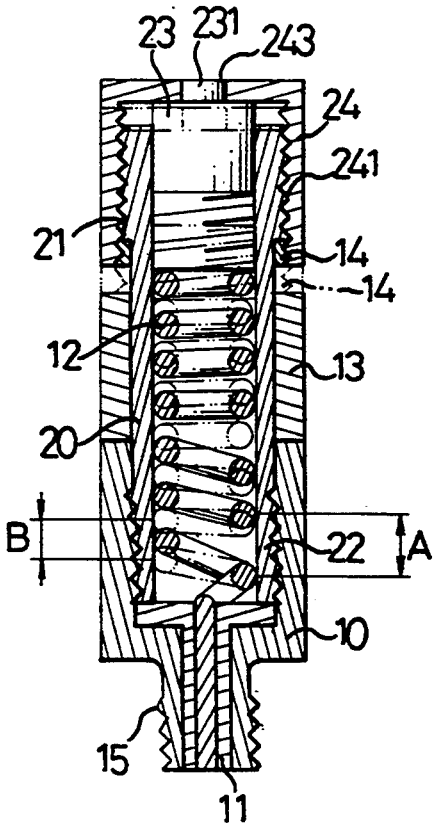
FIG. 4 is a cross-sectional view illustrating adjustment of the pitch of the coil of the antenna assembly.

Referring now to FIG. 4, when the receiving frequency and the standing-wave ratio are interfered with by terrains or in a bad receiving status, the user may simply adjust the pitch of the coil 12 under rotation of the cap 24 which urges the compressing member 23 to move downward to compress the coil 12, thereby adjusting the pitch of the coil 12 from A to B.

It is appreciated that the ring 14 and/or the second tubular member 13 may be omitted without affecting the operation. Nevertheless, provision of the ring 14 may prevent excessive upward movement of the cap 24 as the user may stop further upward movement thereof as soon as he or she notices that the cap 24 disengages from the ring 14.

Although the invention has been explained in relation to its preferred embodiment, it is to be understood that many other possible modifications and variations can be made without departing from the spirit and scope of the invention as hereinafter claimed.

I claim:

1. An adjustable antenna assembly for a portable telephone comprising:

a tubular base removably attached to a portable telephone;

a socket securely received in the tubular base and having an outer periphery which is threaded on an upper end thereof;

a coil received in the socket with a lower end thereof electrically connected to the telephone for receiving and transmitting wireless signal waves to the telephone;

a cap having a closed upper end and an open lower end, and having a threaded inner periphery;

a ring mounted around the socket below the cap and having outer threadings which align with and have a lead the same as that of the threadings of the inner periphery of the cap, the cap being threadedly mounted around the upper end of the socket together with the ring, thereby being movable relative to the socket together with the ring along a longitudinal direction of the coil upon rotational movement thereof; and a compressing member mounted between an upper end of the coil and the upper end of the cap such that a pitch of the coil is adjustable upon adjustment of relative longitudinal position between the cap and the socket.

2. The adjustable antenna assembly as claimed in claim 1 wherein the cap defines a hole in the upper end thereof and the compressing member has a knob projecting from an upperside thereof for extending through the hole defined in the cap to retain the compressing member.

3. An adjustable antenna assembly for a portable telephone comprising:

a tubular base with a nipple projecting from a bottom thereof to be removably connected to a portable telephone;

a guiding member substantially T-shaped in section being mounted in an inner side of the tubular base and having a hollow vertical section passing through the nipple;

a socket having a lower end securely received in the tubular base and an upper end which has an outer threadings;

a coil received in the socket with a lower end thereof extending through the vertical section of the T-shaped guiding member to connect the telephone for receiving and transmitting wireless signal waves to the telephone;

a cap having a closed upper end an open lower end, and a threaded inner periphery;

a ring mounted around the socket below the cap and having outer threadings which align with and have a lead the same as that of the threadings of the inner periphery of the cap, the cap being threadedly mounted around the upper end of the socket together with the ring, thereby being movable relative to the socket together with the ring along a longitudinal direction of the coil upon rotational movement thereof; and a compressing member mounted between an upper end of the coil and the upper end of the cap such that a pitch of the coil is adjustable upon adjustment of relative longitudinal position between the cap and the socket.

4. The adjustable antenna assembly as claimed in claim 3 wherein the cap defines a hole in the upper end thereof and the compressing member has a knob projecting from an upperside thereof for extending through the hole defined in the cap to retain the compressing member.

* * * * *